US011417484B2

(12) United States Patent
Guo et al.

(10) Patent No.: US 11,417,484 B2
(45) Date of Patent: Aug. 16, 2022

(54) CONTACTOR

(71) Applicant: Eaton Electrical Ltd., Suzhou (CN)

(72) Inventors: Shunfeng Guo, Suzhou (CN); Suming Xiang, Suzhou (CN)

(73) Assignee: Eaton Electrical Ltd., Suzhou (CN)

( * ) Notice: Subject to any disclaimer, the term of this patent is extended or adjusted under 35 U.S.C. 154(b) by 221 days.

(21) Appl. No.: 16/598,456

(22) Filed: Oct. 10, 2019

(65) Prior Publication Data

US 2020/0144010 A1 May 7, 2020

(51) Int. Cl.
*H01H 50/24* (2006.01)
*H01H 50/08* (2006.01)

(52) U.S. Cl.
CPC ..... *H01H 50/24* (2013.01); *H01H 50/08* (2013.01)

(58) Field of Classification Search
CPC ..... H01H 50/546; H01H 50/02; H01H 50/32; H01H 50/323; H01H 50/08; H01H 50/24
See application file for complete search history.

(56) References Cited

U.S. PATENT DOCUMENTS 5,424,900 A * 6/1995 Kiiskinen ..... H01H 50/08 335/132
5,483,212 A * 1/1996 Lankuttis ..... H01H 11/0031 335/132
5,907,267 A * 5/1999 Reid ..... H01H 9/167 335/17
5,908,267 A 5/1999 Reid et al.
5,914,664 A * 6/1999 Scheele ..... H03K 17/968 340/644
7,655,876 B2 * 2/2010 Srinivasan ..... H01H 71/462 200/308
8,514,041 B2 * 8/2013 Naka ..... H01H 50/541 335/202

FOREIGN PATENT DOCUMENTS

CN 202549743 U 11/2012
CN 103094009 B 4/2015
EP 1241699 A1 9/2002

OTHER PUBLICATIONS

FR Office Action, FR Application No. 1911294, dated Nov. 26, 2021, 5 pages (not yet received).
FR Office Action, FR Application No. 1911294, dated Nov. 26, 2021, 5 pages.

* cited by examiner

*Primary Examiner* — Bernard Rojas
(74) *Attorney, Agent, or Firm* — Stanek Lemon Crouse & Meeks, P.A.

(57) ABSTRACT

A contactor is provided in the present utility model, the contactor comprising: a housing; a static iron core, a movable iron core, and a contact holder positioned in the housing, wherein the static iron core is fixed to the housing, the movable iron core and the static iron core are disposed opposite to each other, and the contact holder is fixed to the movable iron core; and a built-in switch positioned in the housing, wherein the built-in switch comprises a static contact piece fixed to the housing and a moving contact piece fixed to the contact holder, and the contact holder is configured to drive the moving contact piece to move so as to switch an on/off state of the built-in switch. The contactor of the present utility model has high expandability and improves the convenience of connecting to an external circuit module.

11 Claims, 6 Drawing Sheets

CONTACTOR

CROSS-REFERENCE TO RELATED APPLICATIONS

The present application claims priority to Chinese Patent Application No. 201821654999.1; filed Oct. 12, 2018, entitled CONTACTOR, the disclosure of which is incorporated herein by reference in its entirety.

TECHNICAL FIELD

The present utility model relates to switch equipment, and in particular, to a contactor.

BACKGROUND

A contactor is a type of electrical device used for switching on or switching off a main circuit, and is commonly used for scenarios relating to electric power, power distribution, and power utilization. The principle of a contactor is as follows: when a coil of the contactor is energized, a strong magnetic field is generated, such that a static iron core generates a magnetic force that attracts a movable iron core; the movable iron core drives a contact holder and a moving contact to act, causing a normally closed contact to open or a normally open contact to close. When the coil is de-energized, the magnetic force disappears, and the movable iron core is released under the action of a spring, causing the contact to recover, i.e., causing the normally closed contact to close or the normally open contact to open.

The contactor has functions such as switching a circuit on and off and low-voltage release protection; however, whether contactors in the prior art are in an open state or a closed state cannot be intuitively and conveniently known, and thus a state of the contactor or a related external circuit module cannot be controlled based on an on/off state of the contactor.

SUMMARY OF THE UTILITY MODEL

In view of the above technical problems that exist in the prior art, a contactor is provided in the present utility model, comprising: a housing; a static iron core, a movable iron core, and a contact holder positioned in the housing, wherein the static iron core is fixed to the housing, the movable iron core and the static iron core are disposed opposite to each other, and the contact holder is fixed to the movable iron core; and a built-in switch positioned in the housing, wherein the built-in switch comprises a static contact piece fixed to the housing and a moving contact piece fixed to the contact holder, and the contact holder is configured to drive the moving contact piece to move so as to switch an on/off state of the built-in switch.

Preferably, the built-in switch is a built-in normally open normally closed switch that provides normally open and normally closed switch functions in unison (i.e., a switch comprising at least one normally open switch and at least one normally closed switch that operate in unison), the built-in switch comprising: a first moving contact piece and a second moving contact piece fixed to the contact holder; a first pair of static contact pieces and a second pair of static contact pieces fixed to the housing and positioned between the first moving contact piece and the second moving contact piece, wherein the first pair of static contact pieces corresponds to the first moving contact piece, and the second pair of static contact pieces corresponds to the second moving contact piece.

Preferably, the contactor comprises a moving contact and a static contact disposed opposite to each other, the moving contact is fixed to the contact holder, the static contact is fixed to the housing, and the distance between the first pair of static contact pieces and the first moving contact piece is equal to the distance between the moving contact and the static contact.

Preferably, the housing comprises a first side plate and a second side plate disposed opposite to each other, the first side plate has a first clamping slot and a first toggle through hole, and the contact holder has a first toggle recess corresponding to the first toggle through hole; and the contactor further comprises a first switch detachably mounted on the first side plate, the first switch comprising a first buckle and a first toggle rod, wherein the first buckle is positioned in the first clamping slot, and the first toggle rod passes through the first toggle through hole and is positioned in the first toggle recess.

Preferably, the second side plate has a second clamping slot and a second toggle through hole, and the contact holder has a second toggle recess corresponding to the second toggle through hole; and the contactor further comprises a second switch detachably mounted on the second side plate, the second switch comprising a second buckle and a second toggle rod, wherein the second buckle is positioned in the second clamping slot, and the second toggle rod passes through the second toggle through hole and is positioned in the second toggle recess.

Preferably, the first switch is a first normally open normally closed switch, and the second switch is a second normally open normally closed switch.

Preferably, the first side plate has a first interlocking hole disposed opposite to the contact holder, and a first clamping groove; and the contact holder comprises a first interlocking recess corresponding to the first interlocking hole, and the first interlocking recess is spherical cap-shaped or hemisphere-shaped.

Preferably, the second side plate has a second interlocking hole disposed opposite to the contact holder, and a second clamping groove; and the contact holder comprises a second interlocking recess corresponding to the second interlocking hole, and the second interlocking recess is spherical cap-shaped or hemisphere-shaped.

Preferably, the housing comprises an electrode top plate and a mounting base plate that are disposed opposite to each other and perpendicular to a moving direction of the contact holder, the electrode top plate having a contact holder through hole; and the contactor comprises a contact module detachably mounted on the electrode top plate, the contact module having a switch button; and a contact operating part fixedly connected to the contact holder, the contact operating part extending out from the contact holder through hole and being connected to the switch button, and the contact operating part being configured to drive the switch button to move so as to switch an on/off state of the contact module.

Preferably, the contact operating part comprises: an operating part, the operating part being plate-shaped and parallel to the electrode top plate; and a connecting part for fixing the operating part to the contact holder.

Preferably, the electrode top plate further comprises: a sliding groove; and a baffle disposed at an edge of the sliding groove, the baffle and a portion of the sliding groove defining an accommodation space.

Preferably, the housing comprises a third side plate and a fourth side plate disposed opposite to each other; and the contactor further comprises: a coil bobbin disposed on the static iron core; a first conductive piece and a second conductive piece that are fixed to the coil bobbin, one end of the first conductive piece and one end of the second conductive piece extending toward and being close to the third side plate, and the other end of the first conductive piece and the other end of the second conductive piece extending toward and being close to the fourth side plate; and a first pluggable wiring module, the first pluggable wiring module having two wiring terminals, and the two wiring terminals of the first pluggable wiring module passing through the third side plate to respectively clamp the one end of the first conductive piece and one end of the second conductive piece.

Preferably, the contactor further comprises a second pluggable wiring module, the second pluggable wiring module having two wiring terminals, and the two wiring terminals of the second pluggable wiring module passing through the fourth side plate to respectively clamp the other end of the first conductive piece and the other end of the second conductive piece.

Preferably, the electrode top plate has a first expanded hole and a second expanded hole; and the contactor further comprises: a first auxiliary metal piece, one end of the first auxiliary metal piece clamping the first conductive piece, and the other end thereof being positioned at an opening of the first expanded hole or extending out from the first expanded hole, and a second auxiliary metal piece, one end of the second auxiliary metal piece clamping the second conductive piece, and the other end thereof being positioned at an opening of the second expanded hole or extending out from the second expanded hole.

The present utility model provides added convenience when mounting a contactor by facilitating the wiring between the contactor and an external circuit module. The contactor of the present utility model and a related circuit can be intelligently controlled by an external control circuit, a signal transmission circuit, and the like. The contactor is further provided with heightened application of intelligence by allowing users to monitor the state of the contactors. The present utility model advances the application and development of intelligent and communication-enabled contactors.

BRIEF DESCRIPTION OF THE DRAWINGS

Embodiments of the present utility model are further described below with reference to the accompanying drawings.

DETAILED DESCRIPTION

To make objectives, technical solutions, and advantages of the present utility model clearer and more comprehensible, the present utility model is further described in detail below through specific embodiments with reference to the accompanying drawings.

Figure 1:
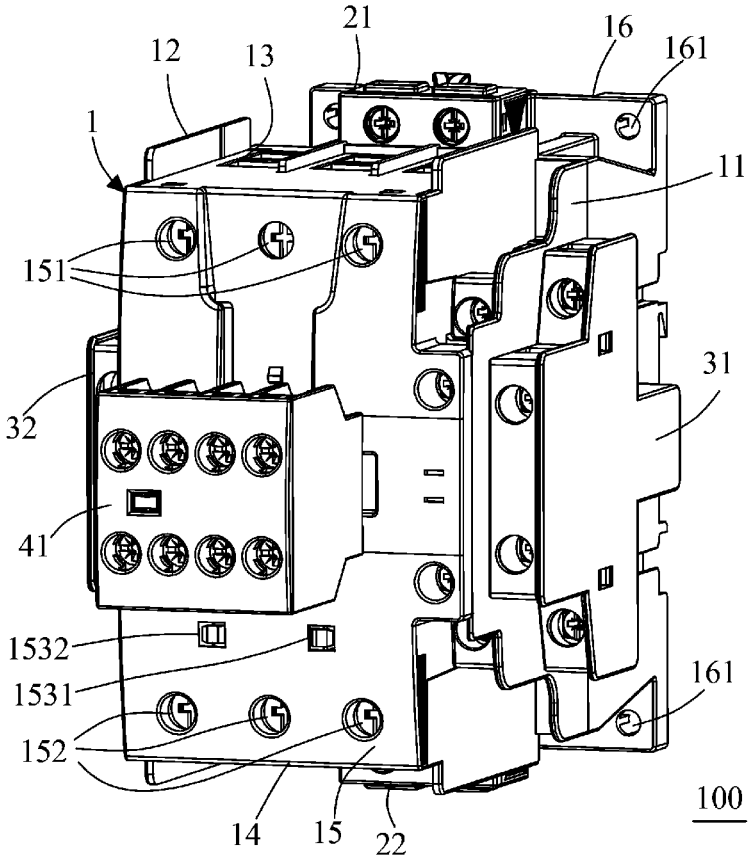
FIG. 1 is a schematic perspective view of a contactor according to a preferred embodiment of the present utility model.
Figure 2:
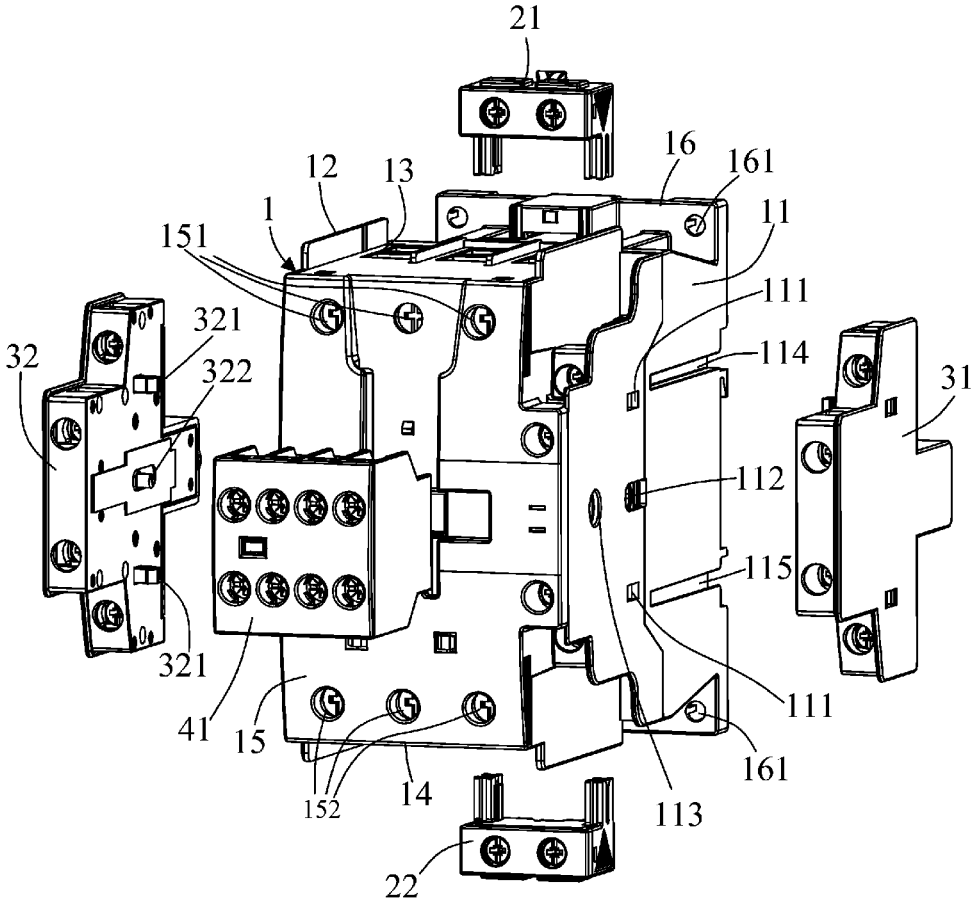
FIG. 2 is an exploded view of the contactor shown in FIG. 1.

FIG. 1 is a schematic perspective view of a contactor according to a preferred embodiment of the present utility model, and FIG. 2 is an exploded view of the contactor shown in FIG. 1. As shown in FIG. 1 and FIG. 2, a contactor 100 includes a substantially cuboid-shaped housing 1. The following are positioned in the housing 1: a static iron core, a movable iron core, a coil bobbin disposed on the static iron core, a coil wound around the coil bobbin, a contact holder fixed to the movable iron core, a moving contact fixed to the contact holder, and a static contact disposed opposite to the moving contact. The operating principle of the contactor 100 of the present utility model is the same as that in the prior art, wherein the static iron core, the movable iron core, the coil bobbin, the moving contact, and the static contact can adopt components therefrom, thus specific shapes, structures, and mounting methods thereof will not be described herein again. Likewise, movements of the movable iron core, the contact holder, and the moving contact are the same as that of the contactor and will not be described herein again.

As shown in FIG. 1 and FIG. 2, the housing 1 includes a first side plate 11 and a second side plate 12 that are disposed opposite to each other on the right and on the left; a third side plate 13 and a fourth side plate 14 that are disposed opposite to each other on the top and on the bottom and an electrode top plate 15; and a mounting base plate 16 that are disposed opposite to each other on the front and on the back. The first side plate 11 of the housing 1 further has two clamping slots 111 and a toggle through hole 112 positioned between the two clamping slots 111. Similarly, the second side plate 12 also has two clamping slots and a toggle through hole (not shown in FIG. 2). The electrode top plate 15 has six electrode through holes for electrode leads (not shown in FIG. 1 and FIG. 2) to pass through. The six electrode through holes are arranged into two rows on the top and on the bottom, wherein three electrode through holes 151 in the first row are close to the third side plate 13, and three electrode through holes 152 in the second row are close to the fourth side plate 14. The electrode top plate 15 further has a first expanded hole 1531 and a second expanded hole 1532. The mounting base plate 16 has a plurality of mounting holes 161 and is adapted to be fixedly mounted to a cabinet by bolts (not shown in FIG. 1 and FIG. 2).

The contactor 100 further includes a first normally open normally closed switch 31 detachably mounted on the first side plate 11; a second normally open normally closed switch 32 detachably mounted on the second side plate 12; a first pluggable wiring module 21 detachably mounted on the third side plate 13; a second pluggable wiring module 22 detachably mounted on the fourth side plate 14; and a contact module 41 detachably mounted on the electrode top plate 15. The first normally open normally closed switch 31 and the second normally open normally closed switch 32 are arranged symmetrically on the right and on the left, whereas the first pluggable wiring module 21 and the second pluggable wiring module 22 are arranged symmetrically on the top and on the bottom.

The first normally open normally closed switch 31 and the second normally open normally closed switch 32 have the same switching principle: one of the switches is in a normally open state, and the other switch is in a normally closed state. Shapes and structures of a normally open contact and a normally closed contact thereof are well known to those skilled in the art and will not be described herein again.

The second normally open normally closed switch 32 is used as an example below for descriptive purposes. The second normally open normally closed switch 32 has two buckles 321 corresponding to the two clamping slots on the second side plate 12 of the housing 1, and a toggle rod 322 corresponding to the toggle through hole on the second side plate 12. The toggle rod 322 is reciprocated in a stroke direction thereof to switch an on/off state of the second normally open normally closed switch 32. The shapes of the two buckles 321 of the second normally open normally closed switch 32 match shapes of the two clamping slots on the second side plate 12. When mounted, the second normally open normally closed switch 32 is aligned to the second side plate 12, and the two buckles 321 are then inserted into the two corresponding clamping slots; at the same time, the toggle rod 322 passes through the toggle through hole on the second side plate 12 and is inserted into the toggle recess (which will be described below with reference to FIG. 5) on the contact holder of the contactor 100, so that the second normally open normally closed switch 32 is detachably mounted on the second side plate 12. When the contact holder moves in a direction perpendicular to the electrode top plate 15, the contact holder drives the toggle rod 322 of the second normally open normally closed switch 32 to move in the same direction, thereby switching the on/off state of the second normally open normally closed switch 32.

The first side plate 11 of the housing 1 further has an interlocking hole 113, a clamping groove 114, and a clamping groove 115. The interlocking hole 113 is disposed opposite to the contact holder of the contactor 100, and one ends of the clamping grooves 114 and 115 extend to the mounting base plate 16. The second side plate 12 of the housing 1 also has an interlocking hole and clamping grooves. When the two contactors are placed side by side, and the first side plate of one of the contactors is close to the second side plate of the other contactor; a spherical interlocking member is placed in the two aligned and adjacent interlocking holes; and the mounting base plates of the two contactors are fixed in the cabinet, thus able to achieve mechanical interlocking of the two contactors.

Figure 3:
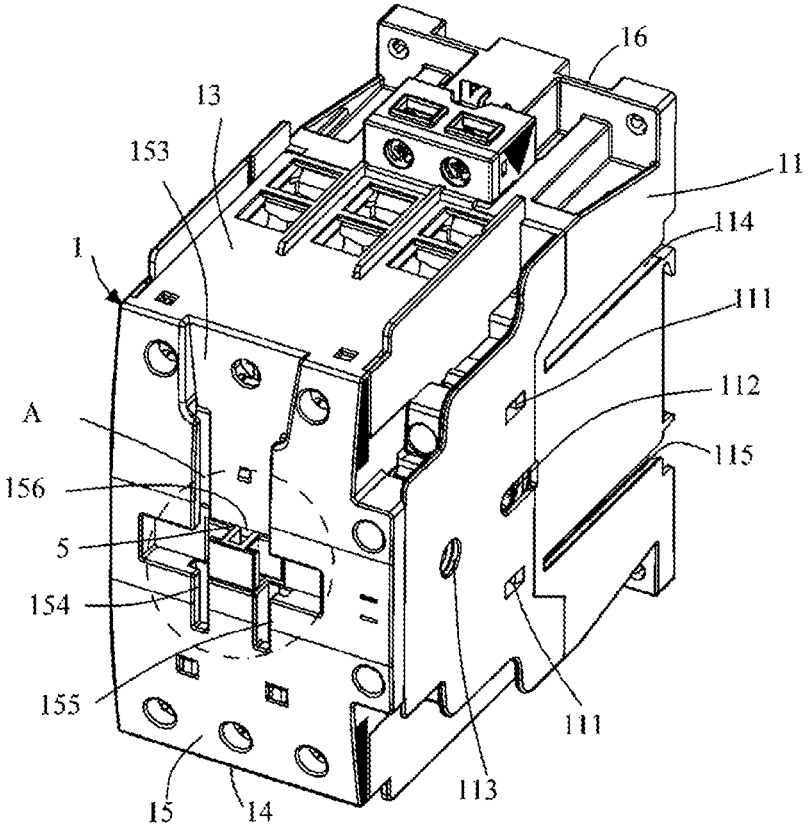
FIG. 3 is a schematic perspective view of the contactor shown in FIG. 1 after a normally open normally closed switch and a contact module are removed.

FIG. 3 is a schematic perspective view of the contactor shown in FIG. 1 after a normally open normally closed switch and a contact module are removed. As shown in FIG. 3, the electrode top plate 15 has a sliding groove 153; a baffle 154 and a baffle 155 that are disposed at an edge of the sliding groove 153; and a contact holder through hole 156 positioned in the sliding groove 153. One end of the sliding groove 153 extends to the edge where the electrode top plate 15 intersects with the third side plate 13, thereby forming an open opening. The contactor 100 further includes a contact operating part 5 fixedly connected to the contact holder in the housing 1, and the contact operating part 5 passes through the contact holder through hole 156 and extends out from the electrode top plate 15.

Figure 4:
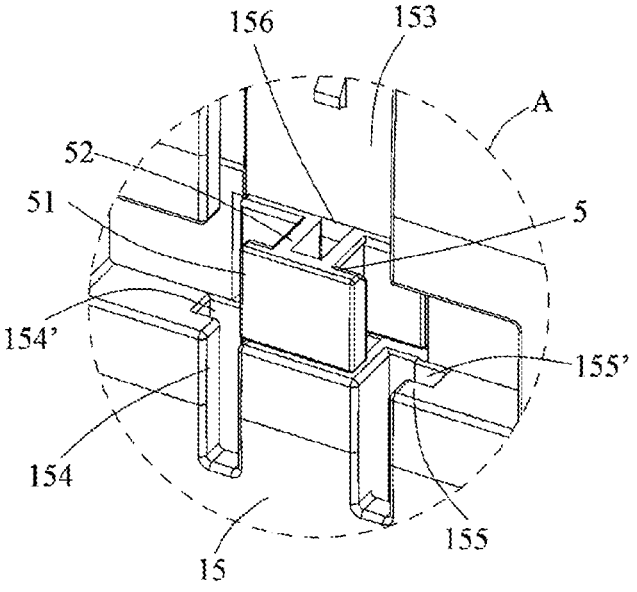
FIG. 4 is a partial enlarged view of region A in FIG. 3.

FIG. 4 is a partial enlarged view of a region A in FIG. 3. As shown in FIG. 4, the baffle 154 and the baffle 155 are disposed opposite to each other and extend in directions toward each other. The baffle 154 and a portion of the sliding groove 153 define an accommodation space 154' whereas the baffle 155 and a portion of the sliding groove 153 define another accommodation space 155'. The contact operating part 5 includes an operating part 51 and a connecting part 52 that fixes the operating part 51 to the contact holder. The operating part 51 is plate-shaped and is parallel to the electrode top plate 15.

Please refer to FIG. 1 again. The contact module 41 includes a plurality of switch contacts positioned in the housing thereof, a switch button disposed opposite to the electrode top plate 15, and two clamping plates (not shown in FIG. 1). The switch button is open ring-shaped. In other words, the switch button is substantially C-shaped so as to match the shape of the operating part 51 of the contact operating part 5 and is used for accommodating the operating part 51. The shapes of the two clamping plates match to the shapes of the accommodation spaces 154' and 155'.

The mounting process of the contact module 41 will be briefly described below with reference to FIG. 1, FIG. 3, and FIG. 4. First, the two clamping plates of the contact module 41 are placed at the edge where the sliding groove 153 intersects with the third side plate 13, then the contact module 41 is slid along the third side plate 13 in a direction pointing towards the fourth side plate 14. When the two clamping plates of the contact module 41 are respectively positioned in the accommodation spaces 154' and 155', in this case the two clamping plates of the contact module 41 are positionally-limited between the bottom of the sliding groove 153 and the baffles 154 and 155; at the same time, the operating part 51 of the contact operating part 5 is positioned within the open ring-shaped switch button, and finally the mounting of the contact module 41 is completed. FIG. 1 shows a schematic perspective view of the contact module 41 after mounting.

When the contact operating part 5 moves in a direction perpendicular to the electrode top plate 15, the contact operating part 5 drives the switch button of the contact module 41 to move together, thereby changing on/off states of the plurality of switch contacts in the contact module 41.

Figure 5:
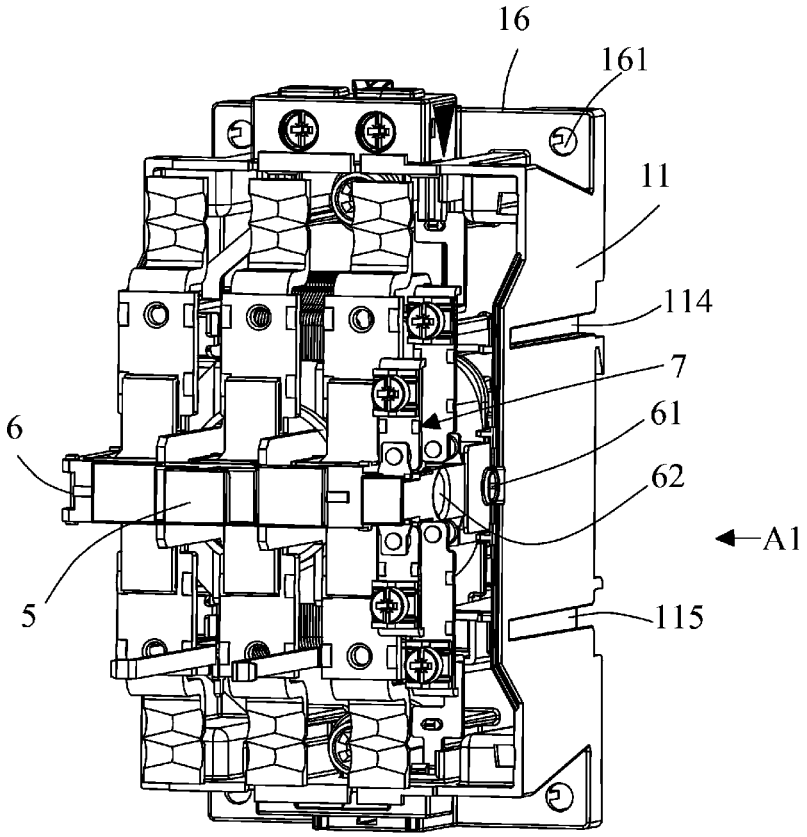
FIG. 5 is a schematic perspective view of the contactor shown in FIG. 3 after an electrode top plate and a portion of first to fourth side plates are removed.

FIG. 5 is a schematic perspective view of the contactor shown in FIG. 3 after an electrode top plate and a portion of first to fourth side plates are removed. As shown in FIG. 5, the contact holder 6 has a toggle recess 61 and an interlocking recess 62 on a side wall close to the first side plate 11. The toggle recess 61 is aligned to the toggle through hole 112 (see FIG. 3) and matches the shape of the toggle rod of the first normally open normally closed switch 31. The interlocking recess 62 corresponds to the interlocking hole 113 (see FIG. 3); the interlocking recess 62 is hemisphere-shaped or spherical cap-shaped and is adapted to accommodate a portion of a spherical, ellipsoidal interlocking member. The contact holder 6 also has, on a side wall close to the second side plate 12, a toggle recess corresponding to the toggle through hole of the second side plate 12, the toggle recess matching the shape of the toggle rod 322 of the second normally open normally closed switch 32; and has an interlocking recess corresponding to the interlocking hole on the second side plate 12.

When the toggle rod of the first normally open normally closed switch 31 passes through the toggle through hole 112 on the first side plate and is inserted into the toggle recess 61 on the contact holder 6, in this case the contact holder 6 will drive the toggle rod of the first normally open normally closed switch 31 to move together. That is, when the contact holder 6 moves in a direction perpendicular to the mounting base plate 16, the contact holder 6 drives the toggle rod of the first normally open normally closed switch 31 to move in the same direction, thereby changing an on/off state of the first normally open normally closed switch 31.

The contactor 100 further includes a built-in normally open normally closed switch 7 positioned in the housing 1 and close to the first side plate 11. The structure and operating principle of the built-in normally open normally closed switch 7 will be described in detail below with reference to FIG. 6 and FIG. 7.

Figure 6:
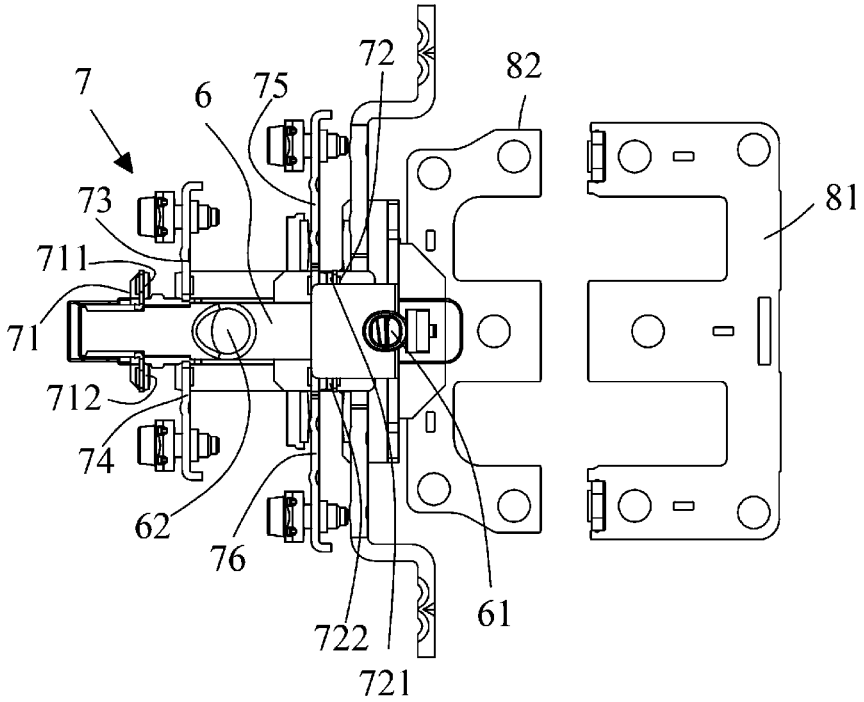
FIG. 6 is a schematic plan view of a static iron core, a movable iron core, a contact holder, and a built-in normally open normally closed switch in a housing of the contactor shown in FIG. 5 in an open state viewed from the direction pointed by an arrow A1 as shown in FIG. 5.
Figure 7:
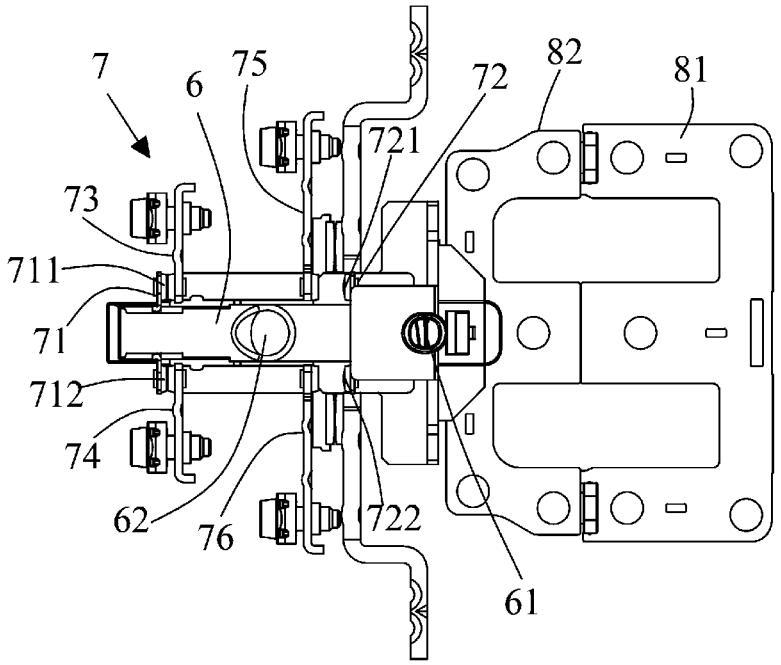
FIG. 7 is a schematic plan view of a static iron core, a movable iron core, a contact holder, and a built-in normally open normally closed switch in a housing of the contactor shown in FIG. 5 in a closed state viewed from the direction pointed by an arrow A1 as shown in FIG. 5.

FIG. 6 and FIG. 7 are schematic plan views of a static iron core, a movable iron core, a contact holder, and a built-in normally open normally closed switch in a housing of the contactor shown in FIG. 5 in an OFF state and an ON state respectively viewed from the direction indicated by an arrow A1 as shown in FIG. 5.

The built-in normally open normally closed switch 7 includes a first moving contact piece 71 and a second moving contact piece 72 fixed to the contact holder 6. The first moving contact piece 71 has two normally open contacts 711 and 712 disposed opposite to each other. The second moving contact piece 72 has two normally closed contacts 721 and 722 disposed opposite to each other. The built-in normally open normally closed switch 7 further includes a first pair of static contact pieces 73 and 74 and a second pair of static contact pieces 75 and 76 that are positioned between the first moving contact piece 71 and the second moving contact piece 72. One ends of the first pair of static contact pieces 73 and 74 respectively correspond to the two normally open contacts 711 and 712 of the first moving contact piece 71, and the other ends are adapted to be fixed to the electrode top plate 15 by screws or bolts. One ends of the second pair of static contact pieces 75 and 76 respectively correspond to the normally closed contacts 721 and 722 of the second moving contact piece 72, and the other ends are adapted to be fixed to the electrode top plate 15 by screws or bolts. The distance between the first pair of static contact pieces 73 and 74 and the first moving contact piece 71 is equal to the distance between the moving contact and the static contact of the contactor 100. Therefore, when the contactor 100 is in the open state, a static iron core 81 is separated from a movable iron core 82 (see FIG. 6), the first moving contact piece 71 and the first pair of static contact pieces 73 and 74 are also in the open state; at the same time, the second moving contact piece 72 and the second pair of static contact pieces 75 and 76 are in the closed state. When the contactor 100 is in the closed state, the static iron core 81 attracts the movable iron core 82 (see FIG. 7), and the first moving contact piece 71 and the first pair of static contact pieces 73 and 74 are also in the closed state; at the same time, the second moving contact piece 72 and the second pair of static contact pieces 75 and 76 are in the open state.

Based on an on/off state of the built-in normally open normally closed switch 7, an external control circuit electrically connected to the built-in normally open normally closed switch 7 can obtain an on/off state of the contactor 100 and can achieve self-locking of the contactor 100 or achieve interlocking between a plurality of contactors.

Figure 8:
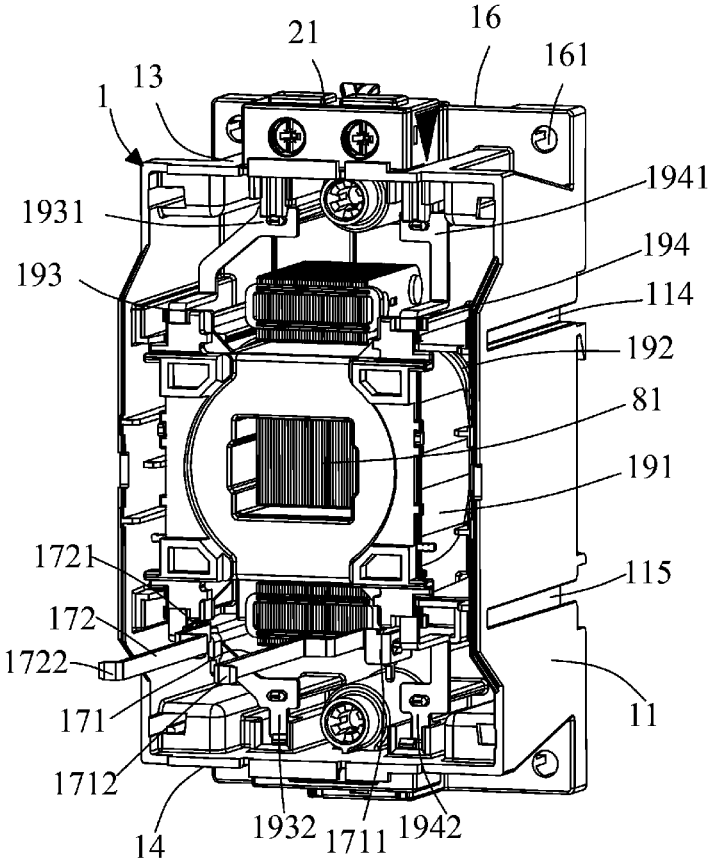
FIG. 8 is a schematic perspective view of the contactor shown in FIG. 5 after a contact holder, a built-in normally open normally closed switch, a moving contact, a static contact, a movable iron core, and a second pluggable wiring module are removed.

FIG. 8 is a schematic perspective view of the contactor shown in FIG. 5 after a contact holder, a built-in normally open normally closed switch, a moving contact, a static contact, a movable iron core, and a second pluggable wiring module are removed. FIG. 8 shows the following positioned in the housing 1: a static iron core 81, a coil bobbin 191, a coil 192, and a first conductive piece 193 and a second conductive piece 194 fixed to the bobbin 191. The first conductive piece 193 and the second conductive piece 194 are made of a metal material (e.g., a copper sheet); one end 1931 of the first conductive piece 193 and one end 1941 of the second conductive piece 194 extend toward the third side plate 13; and the other end 1932 of the first conductive piece 193 and the other end 1942 of the second conductive piece 194 extend toward the fourth side plate 14.

Two wiring terminals of the first pluggable wiring module 21 pass through the third side plate 13 and respectively clamp one end 1931 of the first conductive piece 193 and one end 1941 of the second conductive piece 194. Therefore, the two wiring terminals of the first pluggable wiring module 21 are respectively electrically connected to the first conductive piece 193 and the second conductive piece 194. The coil 192 can be powered by the first pluggable wiring module 21, and the current in the coil 192 can also be monitored by the first pluggable wiring module 21.

As shown in FIG. 8, the contactor 100 further includes a first auxiliary metal piece 171 and a second auxiliary metal piece 172. One end 1711 of the first auxiliary metal piece 171 and one end 1721 of the second auxiliary metal piece 172 respectively clamp the first conductive piece 193 and the second conductive piece 194; the other end 1712 of the first auxiliary metal piece 171 and the other end 1722 of the second auxiliary metal piece 172 extend toward the electrode top plate 15 and are respectively positioned at the openings of the first expanded hole 1531 and the second expanded hole 1532 of the electrode top plate 15 (see FIG. 1). Therefore, current information in the coil 192 is obtained or the coil 192 is powered by the first auxiliary metal piece 171 and the second auxiliary metal piece 172.

The contactor 100 of the present utility model has high expandability, improves the convenience of external wiring, and allows a user to easily detect and monitor the state of the contactor. An on/off state of the contactor 100 can be known based on an external circuit connected to the first normally open normally closed switch 31, the second normally open normally closed switch 32, the first pluggable wiring module 21, the second pluggable wiring module 22, the first and second auxiliary metal pieces 171 and 172, or the contact module 41.

In the contactor 100 of the present utility model, the first normally open normally closed switch 31, the second normally open normally closed switch 32, the first pluggable wiring module 21, the second pluggable wiring module 22, and the contact module 41 are all detachably mounted on the housing 1. Therefore, according to actual needs, the user can mount the first normally open normally closed switch 31 on the first side plate 11 of the housing 1; and/or mount the second normally open normally closed switch 32 on the second side plate 12; and/or mount the first pluggable wiring module 21 on the third side plate 13; and/or mount the second pluggable wiring module 22 on the fourth side plate 14; and/or dispose the contact module 41 on the electrode top plate 15.

The present utility model is not intended to limit the shape of the contact operating part 5, which matches the shape of the open ring-shaped switch button of the contact module 41, thereby driving the switch button to move together.

In another embodiment of the present utility model, the first and second normally open normally closed switches are replaced with normally open switches or normally closed switches.

In another embodiment of the present utility model, the built-in normally open normally closed switch 7 can be replaced with a built-in normally open switch or a built-in normally closed switch.

In another embodiment of the present utility model, the plurality of switch contacts in the contact module 41 can be replaced with normally open contacts and normally closed contacts of a normally open normally closed switch.

In another embodiment of the present utility model, the quantity of the clamping grooves on the first side plate 11 or the second side plate 12 is more or less than two.

In another embodiment of the present utility model, the quantity of the clamping slots on the first side plate 11 or the second side plate 12 is more or less than two.

In another embodiment of the present utility model, the first side plate 11 and the second side plate 12 do not have interlocking holes and clamping grooves, and the contact holder 6 does not have an interlocking recess.

Although the present utility model has been described through preferred embodiments, the present utility model is not limited to the embodiments described here, and further includes various changes and variations made without departing from the scope of the present utility model.

The invention claimed is:

1. A contactor, comprising:

a housing;

a static iron core, a movable iron core, and a contact holder positioned in the housing and configured to actuate a plurality of contacts of a contact module when the contact module is attached to the housing, wherein the static iron core is fixed to the housing, the movable iron core and the static iron core are disposed opposite to each other, and the contact holder is fixed to the movable iron core; and a built-in switch positioned in the housing, wherein the built-in switch comprises a static contact piece fixed to the housing and a moving contact piece fixed to the contact holder, and the contact holder is configured to drive the moving contact piece to move so as to switch an on/off state of the built-in switch, wherein the housing comprises a first side plate and a second side plate disposed opposite to each other, wherein the first side plate has a first clamping slot and a first toggle through hole, wherein the contact holder has a first toggle recess corresponding to the first toggle through hole, wherein the second side plate has a second clamping slot and a second toggle through hole, and wherein the contact holder has a second toggle recess corresponding to the second toggle through hole;

wherein the contactor further comprises a first switch detachably mounted on the first side plate, the first switch comprising a first buckle and a first toggle rod, wherein the first buckle is positioned in the first clamping slot, and the first toggle rod passes through the first toggle through hole and is positioned in the first toggle recess; and wherein the contactor further comprises a second switch detachably mounted on the second side plate, the second switch comprising a second buckle and a second toggle rod, wherein the second buckle is positioned in the second clamping slot, and the second toggle rod passes through the second toggle through hole and is positioned in the second toggle recess.

2. The contactor according to claim 1:

wherein the built-in switch comprises a normally open switch and a normally closed switch that operate in unison;

wherein the moving contact piece comprises a first moving contact piece and a second moving contact piece fixed to the contact holder; and wherein the static contact piece comprises a first pair of static contact pieces and a second pair of static contact pieces fixed to the housing and positioned between the first moving contact piece and the second moving contact piece.

3. The contactor according to claim 1, wherein the first switch comprises a first normally open switch and a first normally closed switch that operate in unison, and the second switch comprises a second normally open switch and a second normally closed switch that operate in unison.

4. The contactor according to claim 1, wherein the first side plate has a first interlocking hole disposed opposite to the contact holder, and a first clamping groove; and the contact holder comprises a first interlocking recess corresponding to the first interlocking hole, and the first interlocking recess is spherical cap-shaped or hemisphere-shaped.

5. The contactor according to claim 1, wherein the second side plate has a second interlocking hole disposed opposite to the contact holder, and a second clamping groove; and the contact holder comprises a second interlocking recess corresponding to the second interlocking hole, and the second interlocking recess is spherical cap-shaped or hemisphere-shaped.

6. A contactor, comprising:

a housing;

a static iron core, a movable iron core, and a contact holder positioned in the housing and configured to actuate a plurality of contacts of a contact module when the contact module is attached to the housing, wherein the static iron core is fixed to the housing, the movable iron core and the static iron core are disposed opposite to each other, and the contact holder is fixed to the movable iron core; and a built-in switch positioned in the housing, wherein the built-in switch comprises a static contact piece fixed to the housing and a moving contact piece fixed to the contact holder, and the contact holder is configured to drive the moving contact piece to move so as to switch an on/off state of the built-in switch, wherein the housing comprises an electrode top plate and a mounting base plate that are disposed opposite to each other and perpendicular to a moving direction of the contact holder, the electrode top plate having a contact holder through hole; and the contactor further comprises the contact module detachably mounted on the electrode top plate; and a contact operating part fixedly connected to the contact holder, the contact operating part extending out from the contact holder through hole and being connected to the contact module, and the contact operating part being configured to drive the contact module so as to switch an on/off state of the plurality of contacts of the contact module.

7. The contactor according to claim 6, wherein the contact operating part comprises:

an operating part, the operating part being plate-shaped and parallel to the electrode top plate; and a connecting part for fixing the operating part to the contact holder.

8. The contactor according to claim 6, wherein the electrode top plate further comprises:

a sliding groove; and a baffle disposed at an edge of the sliding groove, the baffle and a portion of the sliding groove defining an accommodation space.

9. The contactor according to claim 6, wherein the housing comprises a third side plate and a fourth side plate disposed opposite to each other; and the contactor further comprises:

a coil bobbin disposed on the static iron core;

a first conductive piece and a second conductive piece that are fixed to the coil bobbin, one end of the first conductive piece and one end of the second conductive piece extending toward and being close to the third side plate, and the other end of the first conductive piece and the other end of the second conductive piece extending toward and being close to the fourth side plate; and a first pluggable wiring module, the first pluggable wiring module having two wiring terminals, and the two wiring terminals of the first pluggable wiring module passing through the third side plate to respectively clamp the one end of the first conductive piece and one end of the second conductive piece.

10. The contactor according to claim 9, wherein the contactor further comprises a second pluggable wiring module, the second pluggable wiring module having two wiring terminals, and the two wiring terminals of the second pluggable wiring module passing through the fourth side plate to respectively clamp the other end of the first conductive piece and the other end of the second conductive piece.

11. The contactor according to claim 9, wherein the electrode top plate has a first expanded hole and a second expanded hole; and the contactor further comprises:

a first auxiliary metal piece, one end of the first auxiliary metal piece clamping the first conductive piece, and the other end thereof being positioned at an opening of the first expanded hole or extending out from the first expanded hole, and a second auxiliary metal piece, one end of the second auxiliary metal piece clamping the second conductive piece, and the other end thereof being positioned at an opening of the second expanded hole or extending out from the second expanded hole.

* * * * *